US009228386B2

(12) United States Patent
Thielmann et al.

(10) Patent No.: US 9,228,386 B2
(45) Date of Patent: Jan. 5, 2016

(54) SLIDING DOOR FITTING

(71) Applicant: HETTICH-ONI GMBH & CO. KG, Vlotho (DE)

(72) Inventors: Eduard Thielmann, Lage (DE); Alexander Buschmann, Herford (DE); Martin Nordieker, Hullhorst (DE)

(73) Assignee: HETTICH-ONI GMBH & CO. KG, Vlotho (DE)

( * ) Notice: Subject to any disclaimer, the term of this patent is extended or adjusted under 35 U.S.C. 154(b) by 0 days.

(21) Appl. No.: 14/396,797

(22) PCT Filed: Apr. 22, 2013

(86) PCT No.: PCT/EP2013/058247

§ 371 (c)(1),
(2) Date: Oct. 24, 2014

(87) PCT Pub. No.: WO2013/160221

PCT Pub. Date: Oct. 31, 2013

(65) Prior Publication Data

US 2015/0107159 A1 Apr. 23, 2015

(30) Foreign Application Priority Data

Apr. 25, 2012 (DE) ..... 10 2012 103 629

(51) Int. Cl.
*A47B 97/00* (2006.01)
*E05F 5/00* (2006.01)
(Continued)

(52) U.S. Cl.
CPC ..... *E05F 5/003* (2013.01); *E05F 5/027* (2013.01); *E05F 15/00* (2013.01); *E05F 17/002* (2013.01);
(Continued)

(58) Field of Classification Search
CPC ..... F25D 23/025; F25D 23/10; E05F 5/003; E05F 15/00; E05F 5/027; E05F 17/002; E06B 3/4663
USPC ..... 49/61, 62, 63, 67, 142; 312/291, 298
See application file for complete search history.

(56) References Cited

U.S. PATENT DOCUMENTS 1,686,819 A * 10/1928 Kirschbaum ..... 160/96
2,129,923 A * 9/1938 Frankel ..... 312/236
(Continued)

FOREIGN PATENT DOCUMENTS

DE 20-2009-013715 U1 5/2010
DE 10-2010-016592 10/2011
(Continued)

OTHER PUBLICATIONS

Search Report issued in German App. No. Oct. 2013-103629.2 (Apr. 25, 2012).
(Continued)

*Primary Examiner* — Jerry Redman
(74) *Attorney, Agent, or Firm* — Barnes & Thornburg LLP

(57) ABSTRACT

The invention relates to a sliding door fitting for the coupling of a door, which is fastened to at least one hinge, of a refrigerator to a door, which is fastened to at least one further single- or multi-axis hinge, of a furniture carcass in which the refrigerator is installed, wherein the sliding door fitting has a guide element and a slider guided by the guide element, and wherein the guide element can be arranged on one of the doors and the slider can be arranged on the other of the doors. The sliding door fitting is distinguished by having at least one damping device for damping a relative movement between the slider and the guide element over at least one defined portion of the relative movement.

17 Claims, 5 Drawing Sheets

Figure 1A:
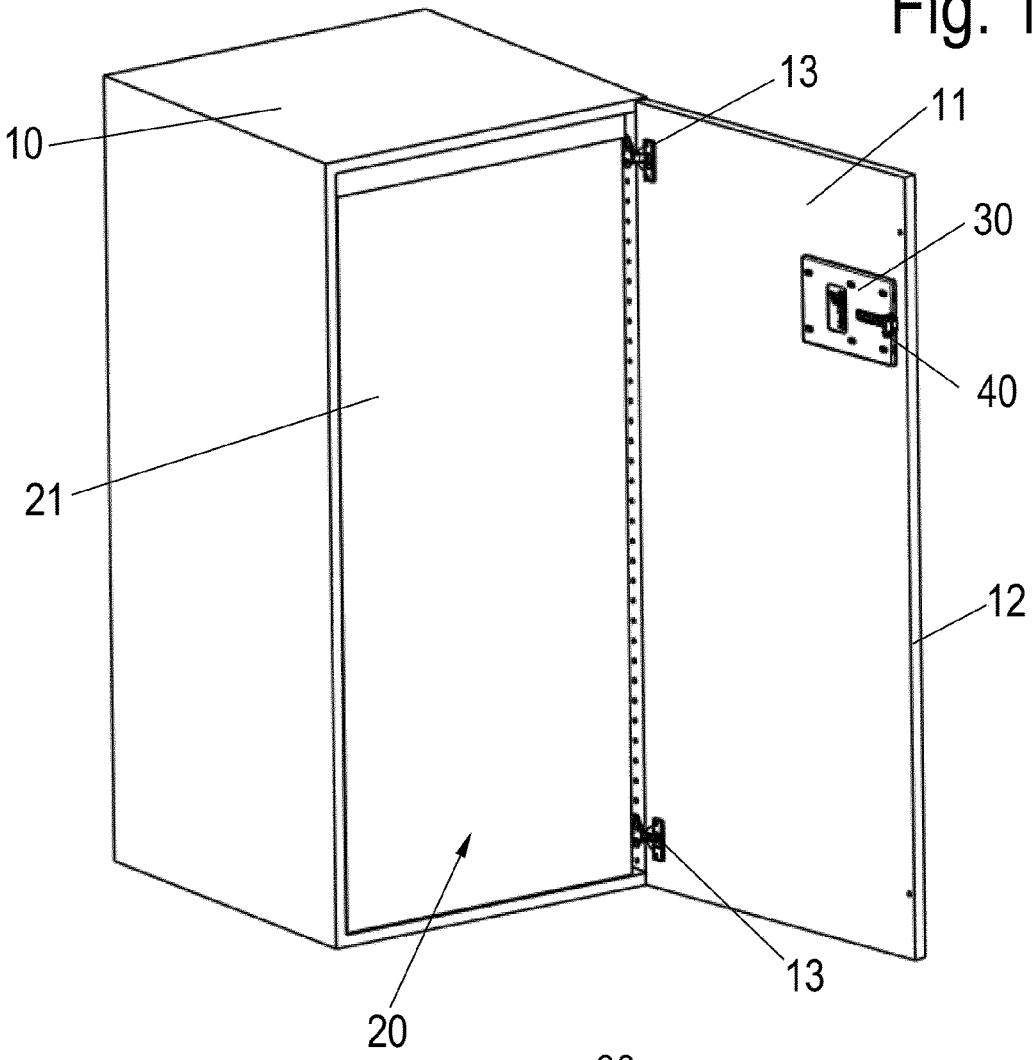

(51) Int. Cl.

| | |
|---|---|
| ***E05F 17/00*** | (2006.01) |
| ***E05F 5/02*** | (2006.01) |
| ***F25D 23/10*** | (2006.01) |
| ***E05F 15/00*** | (2015.01) |
| ***E06B 3/46*** | (2006.01) |
| *F25D 23/02* | (2006.01) |

(52) U.S. Cl.

CPC ..... *E06B 3/4663* (2013.01); *F25D 23/10* (2013.01); *E05Y 2900/302* (2013.01); *F25D 23/02* (2013.01)

(56) References Cited

U.S. PATENT DOCUMENTS

| | | | | | |
|---|---|---|---|---|---|
| 2,233,699 | A | * | 3/1941 | Gorrell | 292/227 |
| 2,444,226 | A | * | 6/1948 | Hamelin | 49/62 |
| 3,287,079 | A | * | 11/1966 | Courson | 312/291 |
| 4,302,907 | A | * | 12/1981 | Canals et al. | 49/65 |
| 4,389,817 | A | * | 6/1983 | Olberding | 49/163 |
| 4,771,269 | A | * | 9/1988 | Pasty et al. | 340/547 |
| 4,912,877 | A | * | 4/1990 | Strydom | 49/171 |
| 5,143,430 | A | * | 9/1992 | Craven et al. | 312/291 |
| 6,371,581 | B1 | * | 4/2002 | Ring et al. | 312/138.1 |
| 8,770,682 | B2 | * | 7/2014 | Lee et al. | 312/291 |
| 8,801,124 | B2 | * | 8/2014 | Jung et al. | 312/405 |
| 2007/0113478 | A1 | * | 5/2007 | Chu et al. | 49/67 |
| 2009/0033187 | A1 | | 2/2009 | Chung | |
| 2011/0043087 | A1 | | 2/2011 | Shih et al. | |
| 2013/0064482 | A1 | | 3/2013 | Jaehrling | |
| 2014/0182208 | A1 | * | 7/2014 | Chen et al. | 49/67 |
| 2015/0033631 | A1 | * | 2/2015 | Asselin et al. | 49/67 |

FOREIGN PATENT DOCUMENTS

| | | |
|---|---|---|
| EP | 0565900 | 10/1993 |
| EP | 2314962 | 4/2011 |
| WO | 2009/011891 | 1/2009 |
| WO | 2011/101319 | 8/2011 |

OTHER PUBLICATIONS

Search Report issued in Int'l App. No. PCT/EP2013/058247 (2013).

* cited by examiner

Fig. 2a
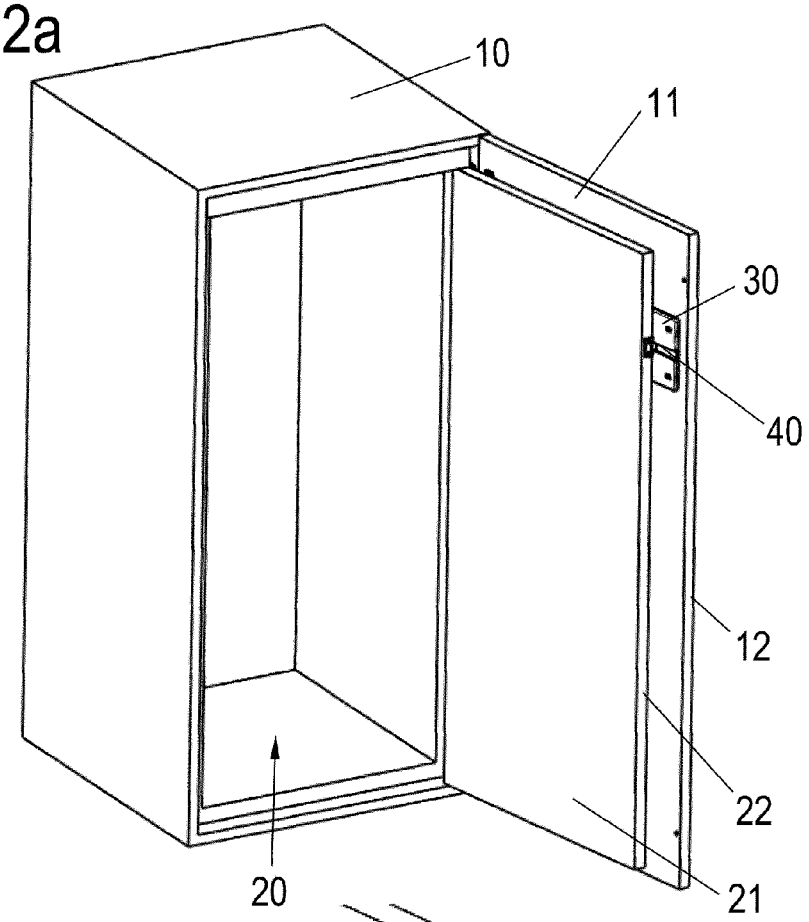
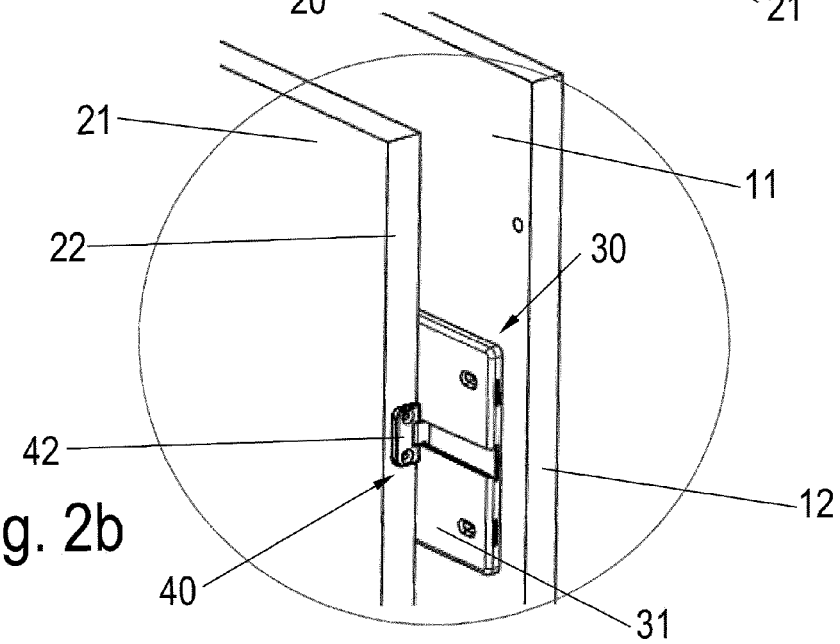
Fig. 2b

SLIDING DOOR FITTING

The disclosure relates to a sliding door fitting for coupling a door of an appliance, for example a refrigerating appliance, which is fastened on at least one hinge, to a door of a furniture body, in which the refrigerating appliance is installed, which is fastened on at least one further single axis or multiaxis hinge. The sliding door fitting has a guide element and a slide guided by the guide element. The guide element is arranged on one of the doors and the slide is arranged on the other of the doors.

To be able to design a kitchen having uniform furniture fronts, installing a refrigerating appliance having a door in a furniture body having a further door is known, wherein both doors typically have different rotational or pivot axes. The door of the refrigerating appliance is referred to hereafter as the appliance door and that of the furniture body is referred to as the furniture door. In the scope of the application, the term refrigerating appliance comprises freezers and also refrigerating appliance-freezer combinations. Furthermore, it is possible to use such a sliding door fitting in conjunction with other built-in domestic appliances having appliance door, for example, with microwave ovens, dishwashers, steam cookers, or baking ovens, etc. Moreover, such a sliding door fitting may be used in any application involving a structure having a hinged door disposed within another structure having a hinged door.

For more convenient operation, both doors are coupled to one another, so that opening or closing of the appliance door is performed by moving the furniture door. For this purpose, a sliding door fitting is known, for example, from the document EP 0 565 900 A1, in which the two doors are coupled to one another with regard to their pivot movement and which balances out a displacement of the edges of the two doors opposite to the hinges, which results from the different rotational or pivot axes.

As in other kitchen furniture doors, it is also desirable for the door of such a built-in refrigerating appliance to damp the closing movement and optionally also the opening movement of the doors. Damping of furniture doors is frequently performed via damping devices, which are integrated in the hinge. Such a type of damping is disadvantageous in the case of the furniture doors of a furniture body for a built-in refrigerating appliance, since such a hinge having integrated damping device usually protrudes relatively far into the interior of the furniture body, whereby the installation width available for the refrigerating appliance in the furniture body would be decreased.

A refrigerating appliance and/or freezer, which is suitable as a built-in appliance in a furniture body, is known from the document EP 2 314 962 A1. In this appliance, a damping device is integrated in the refrigerating appliance door. However, it is also desirable to provide a damping capability for refrigerating appliances which do not have such an integrated damping device.

A damping device is known from the document WO 2011/101319, which is arranged in addition to a sliding door fitting between the furniture door and the device door. Because of the installation depth of this damping device, however, a recess is required in the refrigerating appliance door to enable a desired slight spacing of approximately several millimeters between refrigerating appliance door and furniture door. Therefore, this arrangement also cannot be universally used or retrofitted. In addition, the additional damping device results in increased installation effort during the installation of the refrigerating appliance in the furniture body.

It is therefore an object of the present disclosure to specify an arrangement of a refrigerating appliance in a furniture body, in which the door of the furniture body and that of the refrigerating appliance are coupled to one another and in which a damped movement of both doors is achieved, without the refrigerating appliance having to be designed in a special manner, and without the installation space available for the refrigerating appliance within the furniture body being reduced by the damping function.

An illustrative sliding door fitting according to the disclosure of the type mentioned at the outset is distinguished in that it has at least one damping device for damping a relative movement between the slide and the guide element over at least one defined section of the relative movement.

Due to the integration of the damping device in the sliding door fitting, a compact arrangement for the coupling of the two doors is provided with simultaneous damping of the opening and/or closing movement. The sliding door fitting can be used or retrofitted universally in commercially-available refrigerating appliances in the same manner as known fittings, which are used only for coupling the doors.

In an illustrative embodiment of the sliding door fitting, the slide is guided by the guide element by means of a plain bearing guide. A simple and cost-effective construction of the sliding door fitting is thus enabled.

In a further illustrative embodiment of the sliding door fitting, multiple damping devices are provided, which are arranged adjacent to one another in or on the guide element or in or on the slide. The allocation of the damping action onto multiple damping devices enables the flattest possible damping devices to be used. The arrangement thereof adjacent to one another results in a sliding door fitting having correspondingly low installation height.

In a further illustrative embodiment, the sliding door fitting has at least one force accumulator, which is arranged so that it is tensioned upon opening and/or closing of the doors coupled by the sliding door fitting. The at least one force accumulator may apply force to the slide in relation to the guide element from a specific opening or closing angle of the doors. Furthermore, the at least one force accumulator may be directly or indirectly operationally linked to the at least one damping device and exert a force in a damping direction on the damping device.

In a further illustrative embodiment, the sliding door fitting has at least one carrier, which cooperates with the at least one force accumulator. In this case, the carrier can be guided by a control element, wherein either the control element is implemented in or on the guide element and the carrier is engaged with the slide over at least one further section of the relative movement, or wherein the control element is implemented in or on the slide and the carrier is engaged with the guide element over the at least one further section of the relative movement. The at least one carrier may be mounted so it is pivotable about an axis, which may be approximately perpendicular to a front surface of one of the doors.

A self-closing function of the doors may be implemented, or the closing operation of the doors may be assisted, by the force accumulator. This may simplify operation of the refrigerating appliance and ensure the proper closing of the appliance door, which is important for the function of the appliance.

In a further illustrative embodiment of the sliding door fitting, at least one further damping device is provided for damping the relative movement between the slide and the guide element, which damps the relative movement in a direction which is opposite to the damping direction of the damping device. The doors are thus damped not only during the closing movement, but rather also upon opening to a maximum opening angle. Overstretching of the hinges and also striking of the doors, for example, on a wall, inter alia, can thus be prevented.

In a further illustrative embodiment of the sliding door fitting, the at least one damping device and/or the at least one further damping device is a linearly operating device having cylinder and lifting rod. In a further illustrative embodiment, the at least one damping device and/or the further damping device is a rotational damper, wherein the slide has a push rod, which is implemented at least in sections as a toothed rod. In both mentioned constructions, a damping of the linear displacement movement of the slide in relation to the guide element is possible. In both forms of construction, a flat construction of the damping device is also possible.

In further illustrative embodiments of the sliding door fitting, a carrier plate is arranged so it is pivotable on one end of the slide or the slide has a push rod, which is flexible and on the end of which the carrier plate is arranged at an angle. Because of the different pivot axes of the two doors, the appliance door and the furniture door, the free edges of the doors not only execute a displacement movement in relation to one another during opening or closing of the doors, but rather also a slight pivot in relation to one another. This pivot is enabled by the mentioned features of a pivotable carrier plate or a sufficiently long flexible push rod.

In a further illustrative embodiment, the sliding door fitting has at least one adjustment device for at least one adjustable dimension. Such an adjustment device is, depending on the embodiment, inter alia, the dimension of the damping action and/or the dimension of the force action of the force accumulator and/or the relative position between slide and guide element, from which the damping action begins. The closing and/or opening speed of the coupled doors and/or the closing and/or opening angles of the doors, from which the damping and/or a self-retraction action begins, can thus be adapted to the respective requirements or refrigerating appliances, respectively.

Figure 1B:
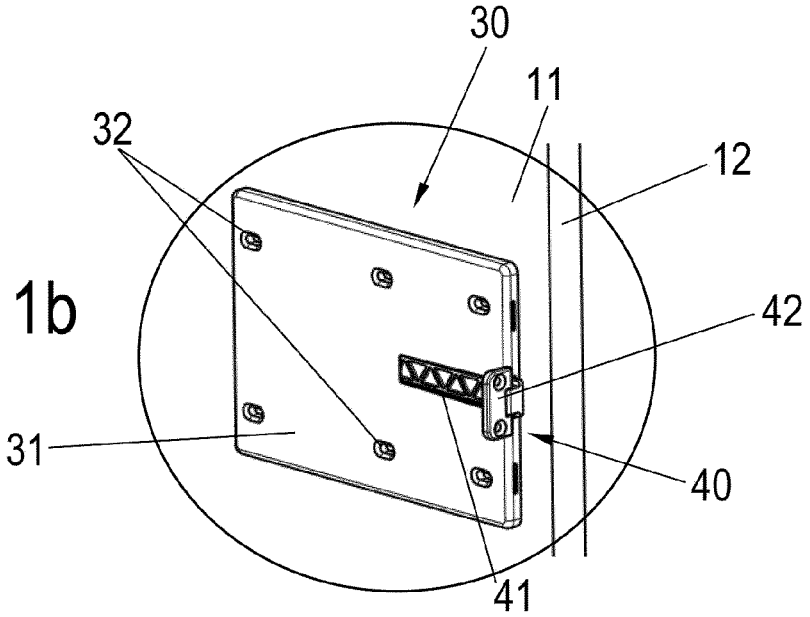

The invention will be explained in greater detail hereafter on the basis of exemplary embodiments with the aid of figures. In the figures:

FIG. 1*a* is a perspective illustration of a furniture body having a built-in refrigerating appliance and partially-installed sliding door fitting;

FIG. 1*b* is a detail view of a portion of FIG. 1*a;*

FIG. 2*a* is a perspective view of the furniture body having built-in refrigerating appliance of FIG. 1*a* with a sliding door fitting installed thereto;

FIG. 2*b* is a detail view of a portion of FIG. 2*a*; and

Figure 3A:
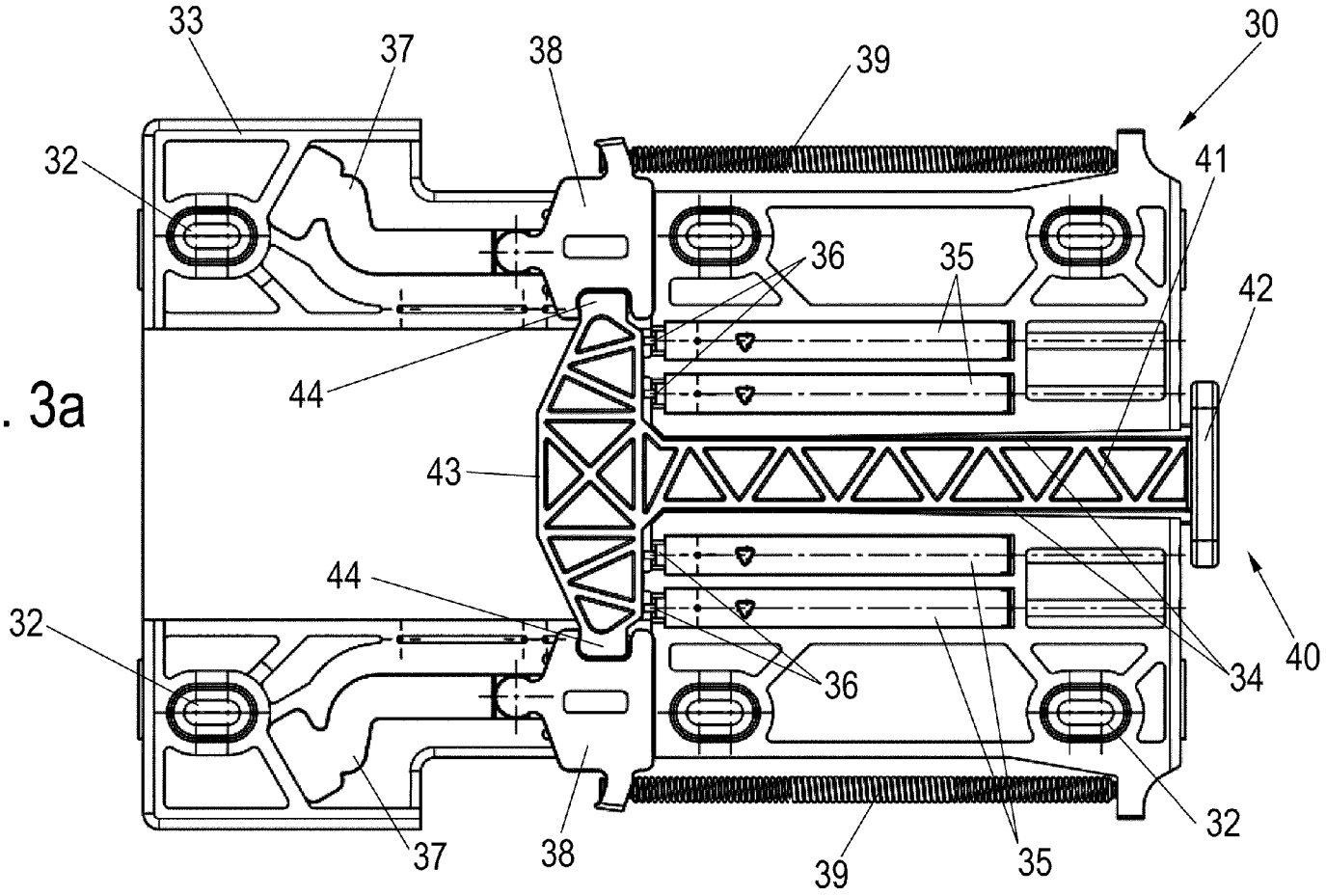
Figure 3B:
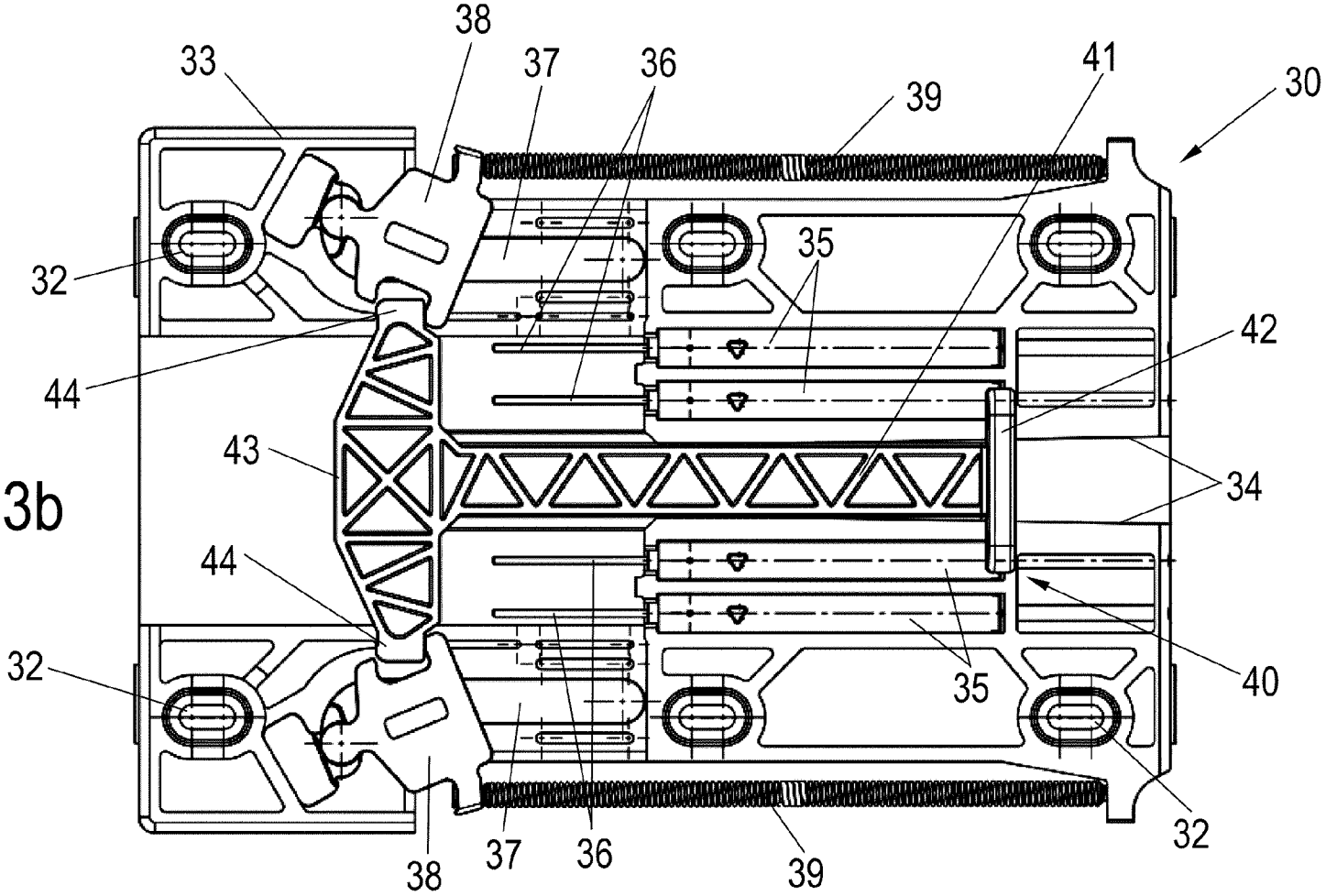
Figure 3C:
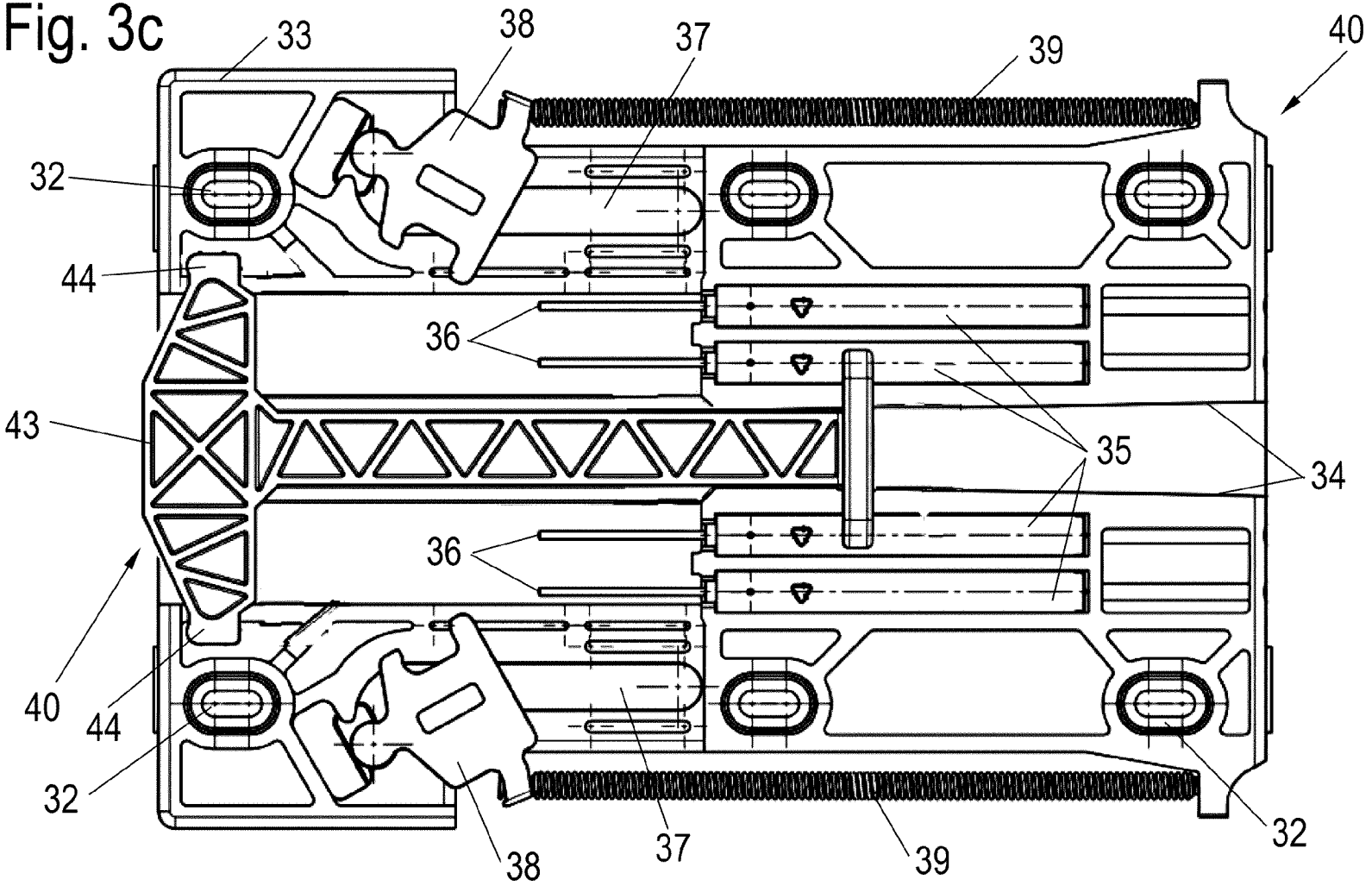

FIGS. 3*a*-3*c* are top views showing a sliding door fitting with a cover removed in various slide positions.

FIG. 1 shows a perspective schematic view of a furniture body 10 having open furniture door 11, which is fastened thereto, for example, via two hinges 13 on a side wall of the furniture body 10. A refrigerating appliance 20, for example, a refrigerator or a freezer, is installed in the furniture body 10. The refrigerating appliance 20 has an appliance door 21, which is shown in the closed position.

A sliding door fitting according to the application is installed in the region of a free edge 12 of the furniture door 11. The sliding door fitting comprises a guide element 30, which is fixed on an interior surface of the furniture door 11, and also a slide 40, which is displaceable in relation to the guide element 30 and is guided by the guide element 30. FIG. 1*a* shows the sliding door fitting installed to the furniture door 11, but not to the appliance door 21, to more clearly illustrate the installation of the sliding door fitting on the furniture door 11.

FIG. 1*b* shows a detail of FIG. 1*a* in the region of the sliding door fitting in an enlarged scale. The guide element 30 has a cover 31 having fastening holes 32, through which the sliding door fitting is screwed onto the furniture door 11. The guide element 30 is embodied as plate-shaped and having a substantially rectangular footprint, with which the guide element 30 rests on the surface of the furniture door 11. Perpendicular to this footprint, the guide element 30 may have a low installation height, for example, several millimeters to approximately 10 mm.

The slide 40 comprises a push rod 41 aligned in parallel to the footprint of the guide element 30, on the free end of which a carrier plate 42, which is approximately perpendicular to the pushrod 41, is attached. The carrier plate 42 and the pushrod 41 are not rigidly connected to one another, but rather by means of a hinge, which is formed by a pin connecting the pushrod 41 and the carrier plate 42. The angle between the pushrod 41 and the carrier plate 42 can be varied within an angle range because of the hinge.

FIG. 2*a* shows, in a similar manner as FIG. 1*a*, the refrigerating appliance 20 installed in the furniture body 10, but with the sliding door fitting attached to both the furniture door 11 and the appliance door 21. The furniture door 11 and the appliance door 21 are coupled to one another in the region of their pivotable free edges 12 or 22, respectively, which are opposite to the hinges of the doors 11, 21, by the sliding door fitting. In the illustrated example, both doors 11, 21 are open. The hinges bearing the appliance door 21 of the refrigerating appliance 20, which are not visible in this figure, may be pin hinges.

FIG. 2*b* shows, in a similar manner to FIG. 1*b*, a detail from FIG. 2*a* in the region of the sliding door fitting. The carrier plate 42 rests on the free edge 22 of the appliance door 21 and is connected thereto, for example, by a screw connection. Upon opening of the furniture door 11 or the appliance door 21, the free edges 12 or 22, respectively, of the two doors 11, 21 execute a relative movement in relation to one another, which results in a displacement of the two edges 12, 22, on the one hand, and in a slight pivot of the two edges 12, 22 in relation to one another, on the other hand. The pivot of the two edges 12, 22 in relation to one another is compensated for by the tilting capability of the carrier plate 42 in relation to the pushrod 41. The displacement of the edges 12, 22 in relation to one another results in a displacement of the slide 40 in relation to the guide element 30. Accordingly, in FIG. 2*b*, the slide 40 is pushed into the guide element 30 out of its rest position, which is apparent in FIGS. 1*a* and 1*b*. Such a movement into the guide element 30 is possible in spite of the angled protruding carrier plate 42 by way of a corresponding recess in the cover 31.

FIGS. 3*a*-3*c* show an illustrative sliding door fitting in greater detail. To enable a view into the internal construction of the sliding door fitting, the sliding door fitting is shown in all three cases without the cover 31.

FIGS. 3*a*, 3*b*, and 3*c* show the slide 40 in three different positions with respect to the guide element 30. FIG. 3*a* shows the sliding door fitting having the slide 40 in the rest position, which is also shown in FIGS. 1*a* and 1*b*. FIG. 3*c* shows an end position of the slide 40, in which it is maximally pushed into the guide element 30. FIG. 3*b* shows a middle position of the slide 40, which lies between the rest position of FIG. 3*a* and the end position of FIG. 3*c*.

The guide element 30 has a base plate 33, on which the cover 31 visible in FIGS. 1*b* and 2*b* is placed. Accordingly, fastening holes 32, which are embodied here as elongated holes, are provided in the base plate 33 at the same position as in the cover 31. It can be provided that the cover 31 latches with the base plate 33. In the installed state, it is additionally held by the shared fastening screws. The base plate 33 can be manufactured in one piece, for example, as an aluminum or zinc die-cast part or plastic injection-molded part.

A guide 34, which is aligned in the longitudinal direction of the base plate 33, is implemented in the base plate 33, for example, as a dovetail or T-groove plain bearing guide. The guide 34 is arranged centrally with respect to the transverse direction of the base plate 33. The slide 40 is inserted with its pushrod 41, which is adapted in its profile to the guide 34, into the guide 34.

At its opposite end in the interior of the guide element 30 and the carrier plate 42, the pushrod 41 merges in a T-shape into a hammer-like head 43. It interacts with this head 43 with the lifting rods 36, which are only visible in the attachment in FIG. 3*a*, of damping devices 35. The damping devices 35 can be air or fluid damping devices, for example. In the present case, four damping devices 35 are provided, which are arranged in pairs of two symmetrically in each case adjacent to the guide 34. Fundamentally, another number of damping devices 35 is possible. Multiple damping devices 35 located adjacent to one another offer the advantage that a sufficiently large damping effect can be achieved in spite of a very low structural height of the sliding door fitting.

In the illustrated exemplary embodiment, known linearly operating cylinder dampers are used as the damping devices 35, the lifting rods 36 of which press in a slightly spring-loaded manner against the head 43, so that the head can move without damping action from the illustrated rest position in the direction of the end positions (to the left in the figures). During a reverse movement into the rest position, the damping action of the damping devices 35 begins when the head 43 is incident on the free ends of the lifting rods 36. The stroke of the lifting rods 36 is less in the illustrated exemplary embodiment in this case than the displacement path which the slide 40 passes through between rest position and end position. Correspondingly, damping is not provided over the entire path, but rather only over a path section lying before the rest position, which is defined by the stroke of the lifting rods 36.

In the guide 34, a certain amount of guide play can be provided, which additionally becomes greater toward the edge region of the base plate 33. In this manner, the pushrod 41 obtains play in a direction perpendicular to the guide direction and parallel to the plane of the base plate. If the rotational or pivot axes of the furniture door 11 and the appliance door 21 do not extend exactly in parallel to one another, this results in a displacement of the edge 22 of the appliance door 21 with respect to its height in relation to the edge 12 of the furniture door 11 during the pivoting of the doors 11, 21. Such a movement can be compensated for by the mentioned play of the pushrod 41.

Furthermore, two control elements are incorporated in the base plate 33, which are implemented here as hooked curves 37. A carrier 38 moves in each of the control elements. The carriers 38 have recesses facing toward one another, in which the head 43 of the slide 40 engages with extensions, referred to as activators 44 hereafter. In addition, a force accumulator, which is implemented here as a spring 39, is assigned to each of the carriers 38. The springs 39 are embodied as traction springs and are each fixed with one end on the carrier 38 and with the other end on a fastening point of the base plate 33, such that the slide 40 is drawn into the rest position via the activators 44 and the carriers 38. In this case, a pre-tension of the springs 39 can be provided in the rest position.

FIG. 3*b* shows the sliding door fitting in a position of the slide 40, which corresponds to an opening angle of the doors 11, 21 of approximately 50°, wherein an opening angle of 0° is associated with closed doors 11, 21 and an opening angle of approximately 90° is associated with perpendicularly opened doors 11, 21.

On the one hand, it can be seen in FIG. 3*b* that the lifting rods 36 of the dampers 35 are already completely extended and no longer press against the head 43. On the other hand, it can be seen that the guide heads of the carriers 38 have nearly reached the end of the hooked curve, whereby the left ends of the receptacle openings in the figure, which cooperate with the activators 44, have already moved away from one another enough that they are no longer engaged with the activators 44. A further movement of the slide 40 in the direction of the end position is therefore possible, without the traction springs 39 being tensioned further.

Because of the shape of the hooked curves 37 and the force engagement points of the springs 39 on cantilever arms of the carriers 38, these remain in the ends of the hooked curves 37. This is apparent in FIG. 3*c*, in which the slide 40 is located in the end position.

This end position is not necessarily reached during use of the sliding door fitting. The sliding door fitting is to be dimensioned so that the length of the displacement path permits a desired maximum opening angle of the furniture door 11 or the appliance door 21, however. It can be provided that the maximum opening angle of the doors 11, 21 is defined by the end position of the sliding door fitting. However, it can also be that the maximum opening position is delimited by the hinges 13 of the furniture body 10 or by the hinges of the refrigerating appliance.

During a closing operation of the doors 11, 21, the slide 40 firstly moves in the direction of the rest positions (to the right in FIGS. 3*a*-3*c*). When passing over the middle position shown in FIG. 3*b*, the carriers 38 are firstly moved out of the end position of the hooked curve 37, whereby the traction force of the springs 39 is applied to the carriers 38 and the slide 40, whereby a self-closing function for the doors 11, 21 is provided. During the further closing operation, the head 43 is placed on the ends of the lifting rods 36 of the damping devices 35, so that the further closing movement occurs in a damped manner up to the rest position of the refrigerating appliance.

In alternative embodiments of the sliding door fitting, it is conceivable to provide, in addition to the damping function during the closing of the furniture door 11 or appliance door 21, a damping during movement of the doors 11, 21 to the maximum opening angle. For this purpose, one or more further damping devices can be arranged in the opposite end region of the base plate 33, against which the head 43 strikes during the movement to the end position, in the guide element 30 in addition to the damping devices 35. The further damping devices can also be implemented as an air or fluid damping device, for example. Since the path to be damped for the further damping devices during movement of the doors 11, 21 to the maximum opening angle can be excessively small, the further damping devices can also be embodied as elastic elements.

In a further embodiment of the sliding door fitting, the linearly operating damping devices 35 shown in FIG. 3*a*-3*c* can also be provided as one or more rotation dampers. For this purpose, the pushrod 41 can be embodied as a toothed rod, for example. Rotation dampers having attached gearwheels are arranged in the base plate 33, which cooperate with the gear teeth of the pushrod 41. It can be provided in this case that the gear teeth are only embodied in sections on the pushrod 41, so that damping is only provided over a predefined displacement path in the region of the rest position.

In a further embodiment of the sliding door fitting, the pushrod 41 can be embodied as sufficiently long that the carrier plate 42 is positioned outside the footprint of the guide element 30 and is not located directly above the base plate 33 over the entire displacement path of the slide 40. The cover 31 accordingly does not need to have the cutout in its upper side, only a recess for the pushrod is to be provided in the side. The guide element 30 can be installed completely concealed between the furniture door 11 and the appliance door 21 in this embodiment and is also not visible in the case of open doors 11, 21. If the pushrod 41 is additionally implemented as slightly flexible, the pivoting ability of the carrier plate 42 in relation to the pushrod 41 can be omitted, since a pivot of the edges 12 or 22, respectively, of the two doors 11, 21 in relation to one another during the opening operation is compensated for by the longer and flexible pushrod 41. The carrier plate 42 can then be embodied in one piece with the pushrod 41, for example, as a plastic injection-molded part.

In a further embodiment of the sliding door fitting, adjustment devices can be provided, which enable the damping action of the at least one damping device 35 to be adjusted. If the damping device 35 is embodied as an air or fluid damping device, an adjustment of the damping action can be performed in a known manner using a throttle screw, for example. It is possible by way of this adjustment device, for example, to adjust the closing and/or opening speed of the cooperating doors 11, 21, which can be necessary in the case of retrofitting on an already existing built-in domestic appliance and a furniture body door.

In a further embodiment of the sliding door fitting, adjustment devices can be provided, which enable the closing and/or opening speed to be adjusted in that the closing and/or opening force of the force accumulator acting on the at least one damping device 35, i.e., for example, the spring 39, is adjustable. This can be performed, for example, by length change of the spring 39 by means of an adjustment screw or a worm gear. If the force accumulator is embodied as a coiled spring, for example, the coiled spring can be wound up more or less by means of the adjustment device, to induce the force change.

In a further embodiment of the sliding door fitting, adjustment devices can be provided which enable the closing and/or opening angle, from which the damping action of the at least one damping device 35 begins, to be varied. In the exemplary embodiment shown, the fastening holes 32 are embodied as elongated holes as a simple adjustment device of this type. An adjustment device which can be actuated after the sliding door fitting is fixedly screwed onto one of the doors is also conceivable. For example, the at least one damping device could be displaced by means of a worm gear or an adjustment screw into the corresponding position. It can be alternatively or additionally provided that the means which activate the at least one damping device 35, for example, the head 43 of the slide 40, is varied in its relative position in relation to the damping device 35 within the sliding door fitting. For this purpose, for example, the at least one damping device 35 can be installed so it is displaceable in relation to the guide element 30 within the sliding door fitting, so that the head 43 of the slide 40 is placed on the end of the lifting rod 36 of the damping device 35 at different positions of the slide 40.

The mentioned adjustment devices act on at least one adjustment dimension of the sliding door fitting. These adjustment dimensions are, depending on the embodiment, inter alia, the closing and/or opening speed of the coupled doors in the case of active damping action and/or the beginning of the damping action from an adjustable closing and/or opening angle.

Although the sliding door fitting is described in the present case in conjunction with a refrigerating appliance, it is apparent that it can also be used in other built-in domestic appliances with separate appliance doors, which are installed in a furniture body having a furniture door.

The invention claimed is:

1. A sliding door fitting for coupling a first door of an appliance to a second door of a furniture body in which the appliance is installed, the first door fastened to the appliance by at least one first hinge having a first hinge axis and the second door being fastened to the furniture body by at least one second single axis or multiaxis hinge having at least a second hinge axis not coaxial with the first hinge axis, the sliding door fitting having a guide element (30) and a slide guided by the guide element, wherein the guide element is to be arranged on one of the first and second doors and the slide is to be arranged on the other of the first and second doors, wherein the sliding door fitting has at least one damping device for damping a relative movement between the slide and the guide element over at least one defined section of the relative movement; and wherein (1) a carrier plate is pivotally connected to one end of the slide, or (2) the slide has a flexible pushrod and a carrier plate is arranged at an angle at the end of the flexible pushrod.

2. The sliding door fitting according to claim 1, wherein the slide is guided by the guide element by means of a bearing guide.

3. The sliding door fitting according to claim 1, wherein multiple damping devices are provided, which multiple damping devices are arranged adjacent to one another in the guide element, on the guide element, in the slide or on the slide.

4. The sliding door fitting according to claim 1, having at least one force accumulator, the force accumulator arranged so that it is tensioned during one or both of the opening and closing of the doors coupled by the sliding door fitting.

5. The sliding door fitting according to claim 4, wherein the at least one force accumulator applies a force to the slide in relation to the guide element from a specific opening or closing angle of the doors.

6. The sliding door fitting according to claim 4, wherein the at least one force accumulator is directly or indirectly operationally linked to the at least one damping device and exerts a force in a damping direction on the damping device.

7. The sliding door fitting according to claim 4, having at least one carrier which interacts with the at least one force accumulator.

8. The sliding door fitting according to claim 7, wherein the at least one carrier is guided by a control element.

9. The sliding door fitting according to claim 8, wherein the control element is integrated with the guide element and wherein the at least one carrier is engaged with the slide over at least a portion of the movement with the slide relative to the guide element.

10. The sliding door fitting according to claim 8, wherein the control element is integrated with the slide and wherein the at least one carrier is engaged with the guide element over at least a portion of the movement of the slide relative to the guide element.

11. The sliding door fitting according to claim 7, wherein the at least one carrier is mounted so that it is pivotable about an axis which is approximately perpendicular to a front surface of one of the doors.

12. The sliding door fitting according to claim 1, wherein at least one further damping device is provided for damping the relative movement between the slide and the guide element, which damps the relative movement in a direction which is opposite to the damping direction of the damping device.

13. The sliding door fitting according to claim 1, wherein one or both of the at least one damping device and the at least one further damping device is a linearly operating device having cylinder and lifting rod.

14. The sliding door fitting according to claim 1, wherein one or both of the at least one damping device and the at least one further damping device is a rotation damper, wherein the slide has a pushrod.

15. The sliding door fitting according to claim 1, wherein a carrier plate is pivotally connected to one end of the slide.

16. The sliding door fitting according to claim 1, wherein the slide has a flexible pushrod and a carrier plate is arranged at an angle at the end of the flexible pushrod.

17. The sliding door fitting according to claim 1, wherein the sliding door fitting has at least one adjustment device for at least one adjustment dimension.

* * * * *